US006939411B2

(12) United States Patent
Serpa

(10) Patent No.: US 6,939,411 B2
(45) Date of Patent: Sep. 6, 2005

(54) METHOD AND TOOL FOR CLEANING A WATERCRAFT SPEEDOMETER

(75) Inventor: Mark Serpa, Fremont, CA (US)

(73) Assignee: SVM Machining, Inc., Fremont, CA (US)

( * ) Notice: Subject to any disclaimer, the term of this patent is extended or adjusted under 35 U.S.C. 154(b) by 0 days.

(21) Appl. No.: 11/043,287

(22) Filed: Jan. 25, 2005

(65) Prior Publication Data

US 2005/0126591 A1 Jun. 16, 2005

Related U.S. Application Data

(63) Continuation of application No. 10/044,270, filed on Jan. 10, 2002, now abandoned.

(51) Int. Cl.[7] ..... B08B 9/04

(52) U.S. Cl. ..... 134/8; 15/104.001; 15/104.03; 15/104.05

(58) Field of Search ..... 15/104.001, 104.03, 15/104.05, 184, 236.01; 134/8

(56) References Cited

U.S. PATENT DOCUMENTS

| | | | | |
|---|---|---|---|---|
| 1,085,240 | A * | 1/1914 | Borst | 15/184 |
| 1,674,593 | A * | 6/1928 | Field | 15/184 |
| 1,965,128 | A * | 7/1934 | Miller | 15/104.09 |
| 2,629,888 | A * | 2/1953 | Sauer | 401/9 |
| 3,180,379 | A * | 4/1965 | Stewart | 408/211 |
| 3,349,615 | A * | 10/1967 | Finkl | 73/182 |
| 3,380,298 | A * | 4/1968 | Wendell | 73/182 |
| 3,824,646 | A * | 7/1974 | Jai | 15/104.095 |
| 3,879,771 | A * | 4/1975 | Nakane | 4/255.01 |
| 4,070,909 | A * | 1/1978 | Carpenter | 73/182 |
| 4,174,049 | A * | 11/1979 | Bolen | 222/5 |
| 4,498,347 | A * | 2/1985 | Grantham et al. | 73/861.66 |
| 4,501,288 | A * | 2/1985 | Field | 137/240 |
| 4,611,488 | A * | 9/1986 | Weingart | 73/182 |
| 4,669,635 | A * | 6/1987 | Brookhart | 222/151 |
| 4,716,613 | A * | 1/1988 | Irwin | 15/104.33 |
| 5,493,748 | A * | 2/1996 | Santo | 15/104.04 |
| 5,544,076 | A * | 8/1996 | Wiggerman et al. | 702/142 |
| 5,583,289 | A * | 12/1996 | Wiggerman et al. | 73/182 |
| 5,937,473 | A * | 8/1999 | Lisowski | 15/236.08 |
| 6,332,819 | B1 * | 12/2001 | Emmons | 441/1 |
| 6,640,370 | B2 * | 11/2003 | Kiefer | 7/170 |

FOREIGN PATENT DOCUMENTS

| | | | |
|---|---|---|---|
| DE | 332905 | * | 2/1921 |
| DE | 940460 | * | 3/1956 |
| GB | 809526 | * | 2/1959 |

* cited by examiner

*Primary Examiner*—Randall Chin
(74) *Attorney, Agent, or Firm*—Hickman Palermo Truong & Becker, LLP

(57) ABSTRACT

A method and tool for cleaning a watercraft speedometer are disclosed. The tool comprises a body, an extraction tip extending therefrom, and at least one edge on the extraction tip that can catch matter in the cavity. The extraction tip is attached to the body and is approximately the size and shape to fit into an intake cavity of a speedometer mechanism so as not to damage the intake cavity. The extraction tip edge is used for extracting debris from the intake cavity. Twisting the extraction tip into the intake cavity and pulling the extraction tip out of the intake cavity results in catching and withdrawing debris from the intake cavity.

13 Claims, 2 Drawing Sheets

METHOD AND TOOL FOR CLEANING A WATERCRAFT SPEEDOMETER

CROSS-REFERENCE TO RELATED APPLICATIONS; PRIORITY CLAIM

This application is a continuation of claims domestic priority under 35 U.S.C. 120 from prior application Ser. No. 10/044,270, filed Jan. 10, 2002, now abandoned, the entire contents of which are hereby incorporated by reference as if fully set forth herein.

FIELD OF THE INVENTION

The present invention generally relates to tools for removing debris from a cavity. The invention relates more specifically to a method and tool for cleaning a watercraft speedometer.

BACKGROUND OF THE INVENTION

Many small watercraft such as pleasure boats, fishing boats and the like are equipped with a water-driven speedometer system that generally comprises an intake assembly, transmission tubing, speedometer mechanism, and dashboard dial. The intake assembly is attached to the rear hull or transom of the boat. The intake assembly includes a forward-facing intake cavity ("pitot tube") that is subjected to water flow as the boat moves forward. The intake cavity is tubular and therefore develops interior pressure proportional to the rate of forward movement. Transmission tubing conveys water under pressure from the intake cavity of a speedometer mechanism, which converts the water pressure into mechanical movement or an electric signal usable by the dashboard dial.

The speedometer will not operate properly, or at all, if the intake cavity becomes blocked. Unfortunately, it is common for algae, weeds, or other debris in the water to foul or clog the intake cavity. In the past, this condition would be detected by the speedometer operating improperly or showing a zero reading when the boat is in motion. In the past the solution has been to flush the intake cavity with a reverse flow of water or air that is applied at the tubing connector. However, this requires availability of a garden hose or pressurized air source at the boat or dock. When these are far from the operating position or mooring position of the boat, cleaning the speedometer intake becomes inconvenient, and the boat operator may be unable to read the speedometer for an extended period of time.

Based on the foregoing, there is a clear need for improved ways to clean a watercraft speedometer.

There is a specific need for a tool that cleans the intake cavity of a watercraft speedometer and that is convenient, transportable, and inexpensive.

SUMMARY OF THE INVENTION

The foregoing needs, and other needs and objects that will become apparent for the following description, are achieved in the present invention, which comprises, in one aspect, a tool for cleaning a watercraft speedometer. In one embodiment, the tool comprises a body and an extraction tip fixed in the body and extending outwardly from the body. The extraction tip has at least one edge for extracting debris from the intake cavity.

According to a second embodiment, the extraction tip is approximately a size and shape to fit loosely into the intake cavity so as not to damage the intake cavity. According to a third embodiment, the tool has two threaded ends and a cap that can be threadedly attached to either threaded end. According to a fourth embodiment, the cap comprises a hole. In one position, the cap covers the extraction tip for safety. In the second position, a float is attached to the hole in the cap, enabling recovery of the tool in case the tool is dropped into water.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENT

A tool for cleaning a watercraft speedometer is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

In general, in one embodiment, a tool for cleaning a watercraft speedometer comprises an extraction tip affixed in a manually graspable body.

Figure 1A:
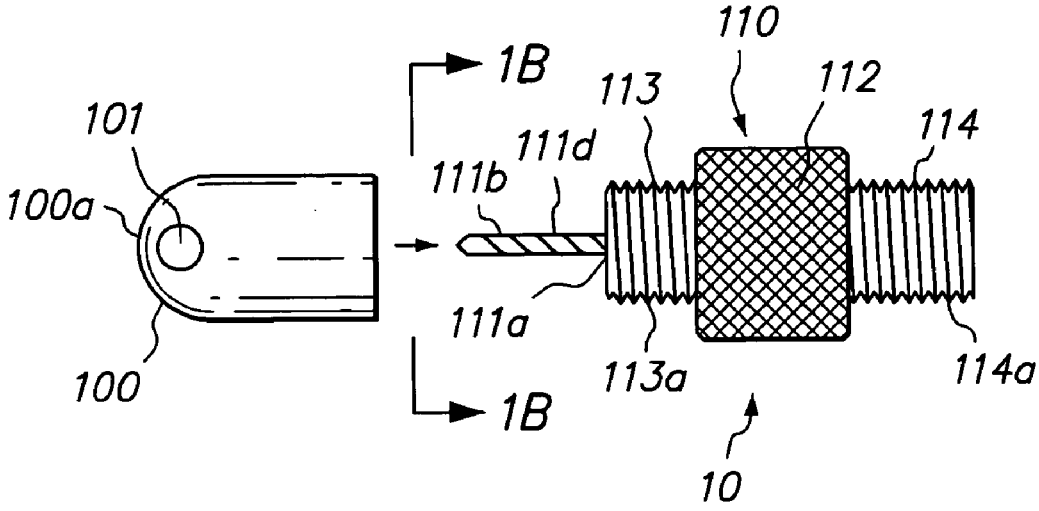
FIG. 1A is a side elevation view of a tool for cleaning a watercraft speedometer intake assembly.

FIG. 1A is a side elevation view of a tool for cleaning a watercraft speedometer, according to one embodiment. A tool 10 comprises a generally cylindrical body 110 having an elongated extraction tip 111 extending longitudinally therefrom, a distal end 113, and a proximal end 114.

The extraction tip 111 is affixed in the distal end 113 of body 110, and may be affixed therein in a permanent manner or a removable manner. In one embodiment, a bore that snugly receives extraction tip 111 is formed or machined in body 110, and the extraction tip 111 is affixed in the bore using a compatible adhesive, such as alpha cyanoacrylate cement (ACC), epoxy resin, or similar means. Alternatively, the bore may be threaded, and extraction tip 111 may have a distal end 111*a* that is tightly threaded into the bore.

In another embodiment, distal end 113 and the proximal end 114 each are formed generally cylindrically and integral with body 110 and have male threads 113*a*, 114*a*, respectively. Such threads are not required, and distal end 113 and proximal end 114 alternatively may be formed as substantially solid elements, in the form of cylinders integral to body 110, or in non-cylindrical form. A generally cylindrical cap 100 having a closed end 100*a* and an open end 100*b* may thread onto either the distal end 113 or proximal end 114 using female threads formed in open end 100*b*. The cap 100 may have a hole 101 oriented perpendicular to a primary axis of the cap, in one embodiment, to facilitate attachment to a float, key ring, or other apparatus. Use of a cap as described herein is optional, and is not required in all embodiments.

The extraction tip 111 has a length approximately equal to the length of a pitot tube or an intake cavity of an intake assembly of a watercraft speedometer, for clear insertion into the intake cavity. Thus, the length of the extraction tip 111 is made slightly shorter than the length of the intake cavity so that the extraction tip 111 does not scratch, damage or drill into the end of the intake cavity when it is inserted. Extraction tip 111 has at least one edge 111*d* that can catch and withdraw matter when the tool 10 is removed following insertion into the intake cavity.

In one specific embodiment, extraction tip 111 is a drill bit, and the edge 111*d* is a flute of the drill bit. A bit having a diameter of 1/16 inch or drill size number 55 is approximately suitable, although other sizes that fit loosely into the pitot tube may be used. In this embodiment, twisting the extraction tip 111 into the intake cavity causes edges 111*b* on the extraction tip 111 to catch debris and urge it outward; any material caught on the extraction tip 111 is then easily extracted by pulling the extraction tip 111 out of the intake cavity.

In one embodiment, cap 110 is used to cover the extraction tip 111 when the cap is threadedly attached to the distal end 113. When the cap 110 is threaded on the distal end 113 of the body 110, it covers the extraction tip 111 to protect from personal injury when the device is not in use. Alternatively, cap 100 is threaded onto proximal end 114. When the cap 100 has a float attached to hole 101 and is threaded on the proximal end 114, the cap 110 provides a way to prevent loss of the tool if it is dropped into the water while in use.

Use of a threaded cap 100 is not required; the cap 100 could be a snap-fit, for example. Body 110 may further have a grip 112 that is knurled for easy handling of the tool when the tool is wet.

The tool may be pocket-sized for convenient attachment to a key chain or other tool. The body 100 may be formed of machined aluminum rod, or formed of other metals such as steel, or formed of an engineering plastic such as Delrin®, or formed of other plastics. The specific material that is used is not critical.

Figure 1B:
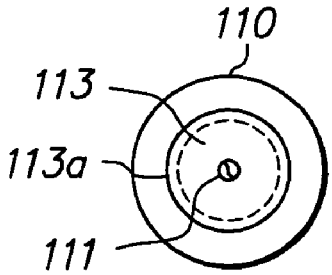
FIG. 1B is an end elevation view taken along line A—A of FIG. 1A.

FIG. 1B is an end elevation view taken along line A—A of FIG. 1A and shows the relationship of the extraction tip 111, proximal end 113, and body 110. According to one embodiment, the distal and proximal ends 113, 114 have a diameter of approximately 7 mm and the body 110 has a diameter of approximately 10 mm, although these dimensions are not required or critical and any other suitable dimensions may be used.

Figure 3:
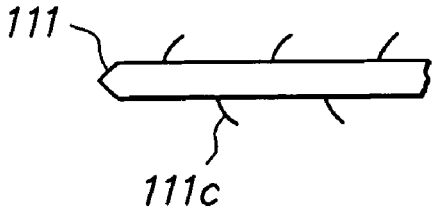
FIG. 3 is a side elevation view of extraction tip with rearwardly projecting barbs.

FIG. 3 is a side elevation view of an alternative embodiment of a tool having extraction tip with rearwardly projecting barbs. In this embodiment, extraction tip 111 is formed as a solid shaft that has one or more rearwardly projecting barbs 111*c*. Since the barbs 111*c* project rearwardly, the extraction tip 111 is easy to insert into an intake cavity but grasps, holds and extracts debris when pulled.

According to another embodiment, the grip is a non-cylindrical shape such as a square. In this embodiment, the cap may have a non-cylindrical shape such as a square tubular shape. In still another embodiment, the extraction tip is removably affixed to the body; for example, the body may comprise a pin vise and the extraction tip may comprise a drill bit held in the pin vise.

Figure 2:
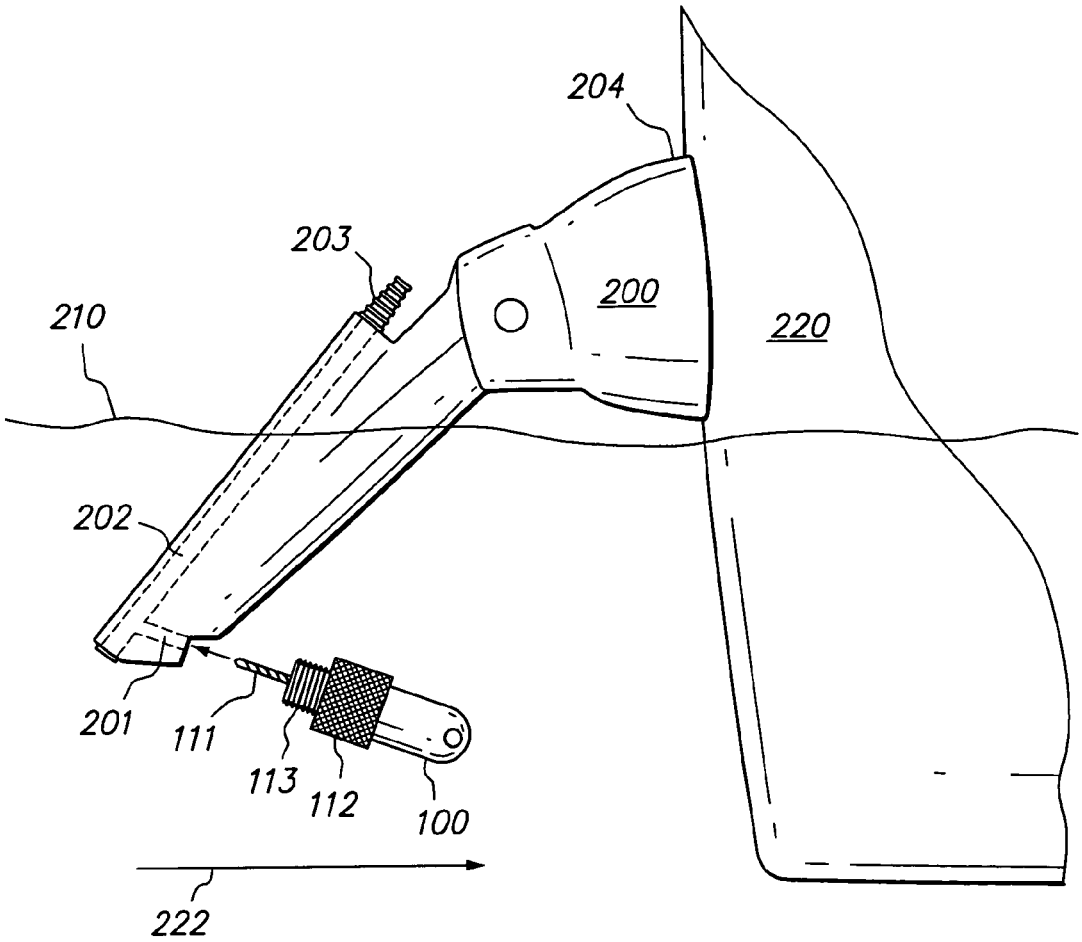
FIG. 2 is a side view of the tool of FIG. 1A shown in operating relationship to an intake cavity of an intake assembly of a speedometer system.

FIG. 2 is a side view of a tool for cleaning an intake cavity of an intake assembly for use in a speedometer system and mounted to the transom of a watercraft. A watercraft speedometer intake assembly 200 has a proximal end 204 that is attached to a boat hull 220, typically at the transom. As the boat hull 222 moves forward in the direction indicated by arrow 222, water 210 enters an intake cavity 201. A pressurized stream of water is developed and travels up tubular cavity 202 to an exit port 203. Flexible tubing is coupled from exit port 203 to electromechanical components of a speedometer system (not shown for clarity) to enable an operator of the boat to discern the speed of the boat. As the boat travels through the water 210, the intake cavity 201 may become clogged with debris such as weeds, algae, dirt, etc. The tool 10 is depicted with a cap 100 attached to the proximal end 114. The tool 210 is depicted in position for insertion into the intake cavity 201. The extraction tip 111 has a diameter and length approximately equal to that of the intake cavity 201. Since the intake cavity 201 is within reaching distance below water 210, a person standing in the boat hull 220 can easily clean the intake cavity 201 with the tool 210. The extraction tip 111 is inserted into the intake cavity 201, the edges on the extraction tip 111 catch the debris in the intake cavity 201 and the debris is extracted when the extraction tip 111 is pulled back out of the intake cavity 201.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A method for cleaning a watercraft speedometer, comprising:

providing a tool comprising a manually graspable body element having a proximal end and a distal end; and a drill bit affixed in and extending outwardly from the distal end of the body element;

twisting the tool and thereby twisting the drill bit into an intake cavity of an intake assembly of the watercraft speedometer to catch debris and urge the debris outward; and pulling the tool and thereby pulling the drill bit and the debris out of the intake cavity.

2. A method as recited in claim 1, wherein the drill bit has a length approximately equivalent to that of an intake cavity of a watercraft speedometer.

3. A method as recited in claim 1, the tool further comprising a securable and removable closure that covers the drill bit when the closure is secured to the tool.

4. A method as recited in claim 1, wherein the drill bit has a length approximately equal to that of the intake cavity.

5. A method as recited in claim 1, the tool further comprising a removable closure having a plurality of female threads that mate with corresponding male threads formed on the body element, wherein the closure covers the drill bit when the closure is threadedly secured to the body element.

6. A method as recited in claim 1, the tool further comprising a removable closure having a plurality of female threads that mate with corresponding male threads formed on the body element, wherein the closure covers the drill bit when the closure is threadedly secured to the body element, and wherein the body element further comprises a hole for accepting a floatation device.

7. A method for cleaning a watercraft speedometer, comprising:

providing a tool comprising means for manually grasping the tool; and means for extracting matter from an intake cavity of the watercraft speedometer comprising a drill bit affixed in the manual grasping means, wherein the extracting means is sized to fit in the intake cavity, wherein the extracting means is affixed to the manual grasping means;

twisting the tool and thereby twisting the extracting means into an intake cavity of an intake assembly of the watercraft speedometer to catch debris and urge the debris outward; and pulling the tool and thereby pulling the extracting means and the debris out of the intake cavity.

8. A method as recited in claim 7, wherein the extracting means further comprises a plurality of sharpened fluted edges for catching and withdrawing matter from the intake cavity when the tool is removed following insertion into the intake cavity.

9. A method as recited in claim 7, the tool further comprising means for covering the extracting means, wherein the covering means is securable to and removable from the tool.

10. A method as recited in claim 7, the tool further comprising means for covering the extracting means, wherein the covering means is securable to and removable from the tool, and wherein the covering means comprises a plurality of female threads that mate with corresponding male threads formed on the manual grasping means, wherein the covering means further comprises a cavity for accepting a floatation device.

11. A method for cleaning a watercraft speedometer, comprising:

(a) providing a tool comprising a manually graspable cylindrical body having male threads formed on each of a proximal end and a distal end of the body; a drill bit affixed in and extending outwardly from the distal end of the body; and a removable closure having a plurality of female threads that mate with the male threads formed on the proximal end and the distal end of the body, wherein the closure covers the drill bit when the closure is threadedly secured to the threads of the distal end of the body;

(b) twisting the tool and thereby twisting the drill bit into an intake cavity of an intake assembly of the watercraft speedometer to catch debris and urge the debris outward; and (c) pulling the tool and thereby pulling the drill bit and the debris out of the intake cavity.

12. A method as recited in claim 11, wherein the drill bit has a length approximately equal to that of an intake cavity.

13. A method as recited in claim 11, wherein the closure further comprises a hole for accepting a floatation device.

* * * * *